US008306462B2

(12) United States Patent
Suzuki et al.

(10) Patent No.: US 8,306,462 B2
(45) Date of Patent: Nov. 6, 2012

(54) ROTOR ROTATING APPARATUS, DEVELOPING APPARATUS, AND IMAGE FORMING APPARATUS

(75) Inventors: Shiro Suzuki, Kanagawa (JP); Wataru Suzuki, Kanagawa (JP); Masahiro Sato, Kanagawa (JP); Atsuyuki Kitamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 318 days.

(21) Appl. No.: 12/700,119

(22) Filed: Feb. 4, 2010

(65) Prior Publication Data

US 2011/0008072 A1 Jan. 13, 2011

(30) Foreign Application Priority Data

Jul. 7, 2009 (JP) ..... 2009-160855

(51) Int. Cl.
*G03G 15/01* (2006.01)

(52) U.S. Cl. ..... 399/227

(58) Field of Classification Search ..... 399/107, 399/119, 120, 222, 223, 226, 227
See application file for complete search history.

(56) References Cited

U.S. PATENT DOCUMENTS

2006/0039720 A1* 2/2006 Miyazawa et al. ..... 399/227

FOREIGN PATENT DOCUMENTS

JP 8095338 A 4/1996

* cited by examiner

*Primary Examiner* — Hoan Tran
(74) *Attorney, Agent, or Firm* — Sughrue Mion, PLLC

(57) ABSTRACT

A rotor rotating apparatus includes: a first rotor that rotates; a second rotor supported rotatably at the first rotor and so as to revolve around an axis of the first rotor with rotation of the first rotor; a drive unit for rotating the second rotor; a transmission member configured to move along a direction of a rotation axis of the second rotor between a transmission position at which the transmission member transmits the drive force from the drive unit to the second rotor and a non-transmission position at which the transmission member idles: and a guide member that moves the transmission member to the transmission position when the first rotor is in a first rotation position, and moves the transmission member to the non-transmission position by rotation of the first rotor from the first rotation position.

13 Claims, 8 Drawing Sheets

ROTOR ROTATING APPARATUS, DEVELOPING APPARATUS, AND IMAGE FORMING APPARATUS

CROSS-REFERENCE TO RELATED APPLICATION

This application is based on and claims priority under 35 USC 119 from Japanese Patent Application No. 2009-160855 filed Jul. 7, 2009.

BACKGROUND

TECHNICAL FIELD

The present invention relates to a rotor rotating apparatus, a developing apparatus, and an image forming apparatus.

SUMMARY

The present invention is provided to reduce rotational load at the time of rotating a second rotor supported rotatably at a first rotor when the first rotor in a predetermined rotation position as compared with the case of moving a transmission member to a transmission position against the elastic force of an elastic member.

According to a first aspect of the invention, a rotor rotating apparatus includes a first rotor that rotates; a second rotor supported rotatably at the first rotor and so as to revolve around an axis of the first rotor with rotation of the first rotor; a drive unit that generates drive force for rotating the second rotor; a transmission member configured to move along a direction of a rotation axis of the second rotor between a transmission position at which the transmission member transmits the drive force from the drive unit to the second rotor and a non-transmission position at which the transmission member idles: and a guide member that moves the transmission member to the transmission position when the first rotor is in a first rotation position, and moves the transmission member to the non-transmission position by rotation of the first rotor from the first rotation position.

BRIEF DESCRIPTION OF THE DRAWINGS

Exemplary Embodiments of the present invention will be described in detail based on the following figures, wherein.

DETAILED DESCRIPTION

An example of an exemplary embodiment according to the present invention will be described below with reference to the drawings.

(Configuration of Image Forming Apparatus According to Exemplary Embodiment)

Figure 1:
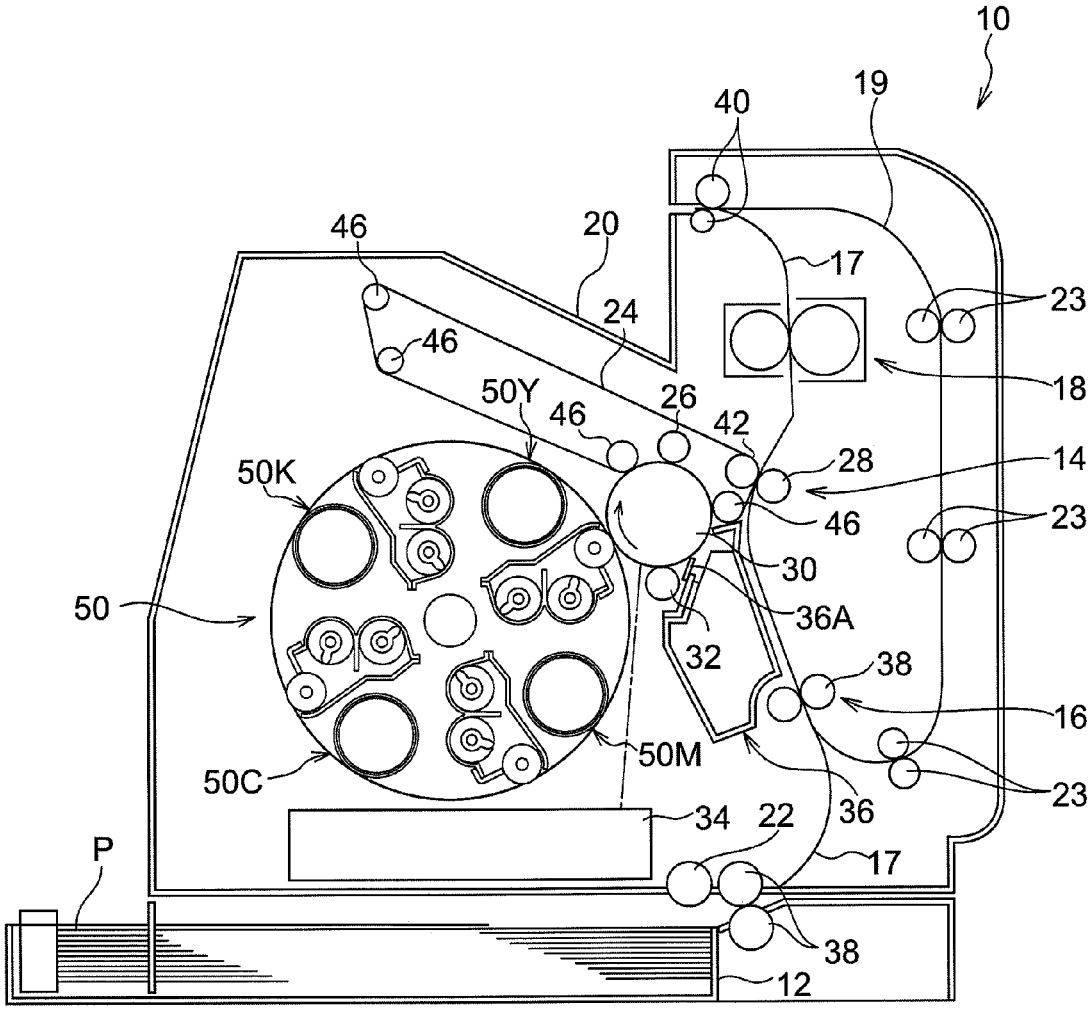
FIG. 1 is a schematic diagram showing the configuration of an image forming apparatus according to an exemplary embodiment.

First, the configuration of an image forming apparatus according to the exemplary embodiment will be described. FIG. 1 is a schematic diagram showing the configuration of an image forming apparatus according to the exemplary embodiment.

An image forming apparatus 10 has, as shown in FIG. 1, a recording medium supplying unit 12 in which recording media P is stored, an image forming unit 14 for forming an image on a recording medium P, a transporting unit 16 for transporting the recording medium P from the recording medium supplying unit 12 to the image forming unit 14, and a recording medium discharging unit 20 discharging the recording medium P on which an image is formed by the image forming unit 14. The recording medium P stored in the recording medium supplying unit 12 includes sheets of paper and films of plastic, metal, or the like.

The image forming unit 14 has, as an example of a latent image holding member that holds a latent image, a photoconductive drum 30 that holds an electrostatic latent image. The photoconductive drum 30 is configured to rotate in one direction (clockwise direction in FIG. 1). The latent image holding member is not limited to the photoconductive drum 30 but may be any component such as a photoconductive belt as long as it holds a latent image.

Around the photoconductive drum 30, in order from the upstream side in the rotational direction of the photoconductive drum 30, there are provided a charging device 32 for charging the photoconductive drum 30, an exposing device 34 for exposing the charged photoconductive drum 30 with light to form an electrostatic latent image on the photoconductive drum 30, a developing device 50 for developing the electrostatic latent image formed on the photoconductive drum 30 to form a toner image, and a cleaning device 36 for removing toner residing on the photoconductive drum 30 by a removing member 36A.

In the developing device 50, developing units 50Y, 50M, 50C, and 50K for each colors of yellow (Y), magenta (M), cyan (C), and black (K) are disposed along the circumferential direction. The concrete configuration of the developing device 50 will be described later.

The photoconductive drum 30 repeats charging, exposing, and developing processes for each of colors of an image to be formed. For example, in the case of forming a full-color image, in the photoconductive drum 30, the charging process performed by the charging device 32, the exposing process performed by the exposing device 34, and the developing process performed by one developing unit selected from the developing units 50Y, 50M, 50C, and 50K are repeated four times for the each of colors of yellow (Y), magenta (M), cyan (C), and black (K), and toner images corresponding to the colors of yellow (Y), magenta (M), cyan (C), and black (K) are sequentially formed.

The image forming unit 14 has: an intermediate transfer member 24 as an example of a member to which the toner image formed on the photoconductive drum 30 is transferred;

a first transfer roll 26 as an example of a transfer device for transferring the toner image formed on the photoconductive drum 30 to the intermediate transfer member 24; a second transfer roll 28 as an example of the transfer device for transferring the toner image transferred to the intermediate transfer member 24 to the recording medium P; and a fixing device 18 for fixing the toner image transferred from the intermediate transfer member 24 to the recording medium P to the recording medium P.

The intermediate transfer member 24 is, for example, a endless-type belt member and is supported in a state where tension is applied by an opposed roll 42 opposing the second transfer roll 28 and plural support rolls 46. The intermediate transfer member 24 makes cyclic movement in one direction (counterclockwise direction in FIG. 1) while being in contact with the photoconductive drum 30. The intermediate transfer member 24 is not limited to a belt but may be any member such as a drum to which a toner image formed on the photoconductive drum 30 is transferred.

The first transfer roll 26 opposes the photoconductive drum 30 while sandwiching the intermediate transfer member 24. A position between the first transfer roll 26 and the photoconductive drum 30 is a first transfer position in which a toner image on the photoconductive drum 30 is transferred to the intermediate transfer member 24. In the first transfer position, the first transfer roll 26 transfers the toner image on the photoconductive drum 30 to the intermediate transfer member 24 by pressure contact and electrostatic force.

The second transfer roll 28 opposes the opposed roll 42 while sandwiching the intermediate transfer member 24. A position between the second transfer roll 28 and the opposed roll 42 is a second transfer position in which a toner image on the intermediate transfer member 24 is transferred to the recording medium P. In the second transfer position, the second transfer roll 28 transfers the toner image on the intermediate transfer member 24 to the recording medium P by pressure contact and electrostatic force.

The transporting unit 16 has a feed roll 22 for feeding the recording medium P stored in the recording medium supplying unit 12, and transport rolls 38 for transporting the recording medium P fed by the feed roll 22 to the second transfer position. The feed roll 22 and the transport rolls 38 are disposed along a first transporting path 17 extending from the recording medium supplying unit 12 toward the recording medium discharging unit 20.

The fixing device 18 is disposed on the downstream side in the transporting direction of the second transfer position and fixes the transfer image transferred in the second transfer position to the recording medium P. On the downstream side in the transporting direction of the fixing device 18, discharge rolls 40 for discharging the recording medium P on which the toner image is fixed by the fixing device 18 to the recording medium discharging unit 20 are disposed.

A second transport path 19 for inverting the recording medium P on one side of which an image is formed and sending it back to the first transport path 17 is also formed. In the second transport path 19, plural pairs of transport rolls 23 for transporting the recording medium P are disposed. At the time of forming an image on both sides, the recording medium P on one side of which an image is formed is switched back by the dischage rolls 40, guided to the second transport path 19, transported downward by the plural transport rolls 23, and sent back to the first transport path 17.

With the configuration, in the image forming apparatus 10 according to the exemplary embodiment, first, the recording medium P fed out from the recording medium supplying unit 12 by the feed roll 22 is sent to the second transfer position by the transport rolls 38.

On the other hand, toner images of the colors formed on the photoconductive drum 30 are overlapped and a color image is formed on the intermediate transfer member 24. The recording medium P send to the second transfer position is transferred the color image formed at the intermediate transfer member 24.

The recording medium P on which the toner images are transferred is transported to the fixing device 18, and the transferred toner images are fixed by the fixing device 18. In the case of forming an image only on only one side of the recording medium P, after the toner images are fixed, the recording medium P is discharged by the discharge rolls 40 to the recording medium discharging unit 20.

In the case of forming an image on both sides of the recording medium P, after an image is formed on one side, the recording medium P is switched back by the discharge rolls 40, inverted, and sent to the second transport path 19. Further, the recording medium P is sent again from the second transport path 19 to the first transport path 17. An image is formed on the other side in a manner similar to the above, so that the images are formed on both sides of the recording medium P. A series of image forming operations are performed as described above.

In the above configuration, the intermediate transfer member 24 is used as a member to which a toner image formed on the photoconductive drum 30 is transferred. The member to which a toner image is transferred may be the recording medium P. That is, the configuration of the image forming apparatus is not limited to the above-described configuration. For example, an image forming apparatus of a direct transfer type of transferring a toner image formed on the photoconductive drum 30 directly to the recording medium P, not to the intermediate transfer member 24 may be used.

(Configuration of Developing Apparatus 50 According to the Exemplary Embodiment)

Figure 2:
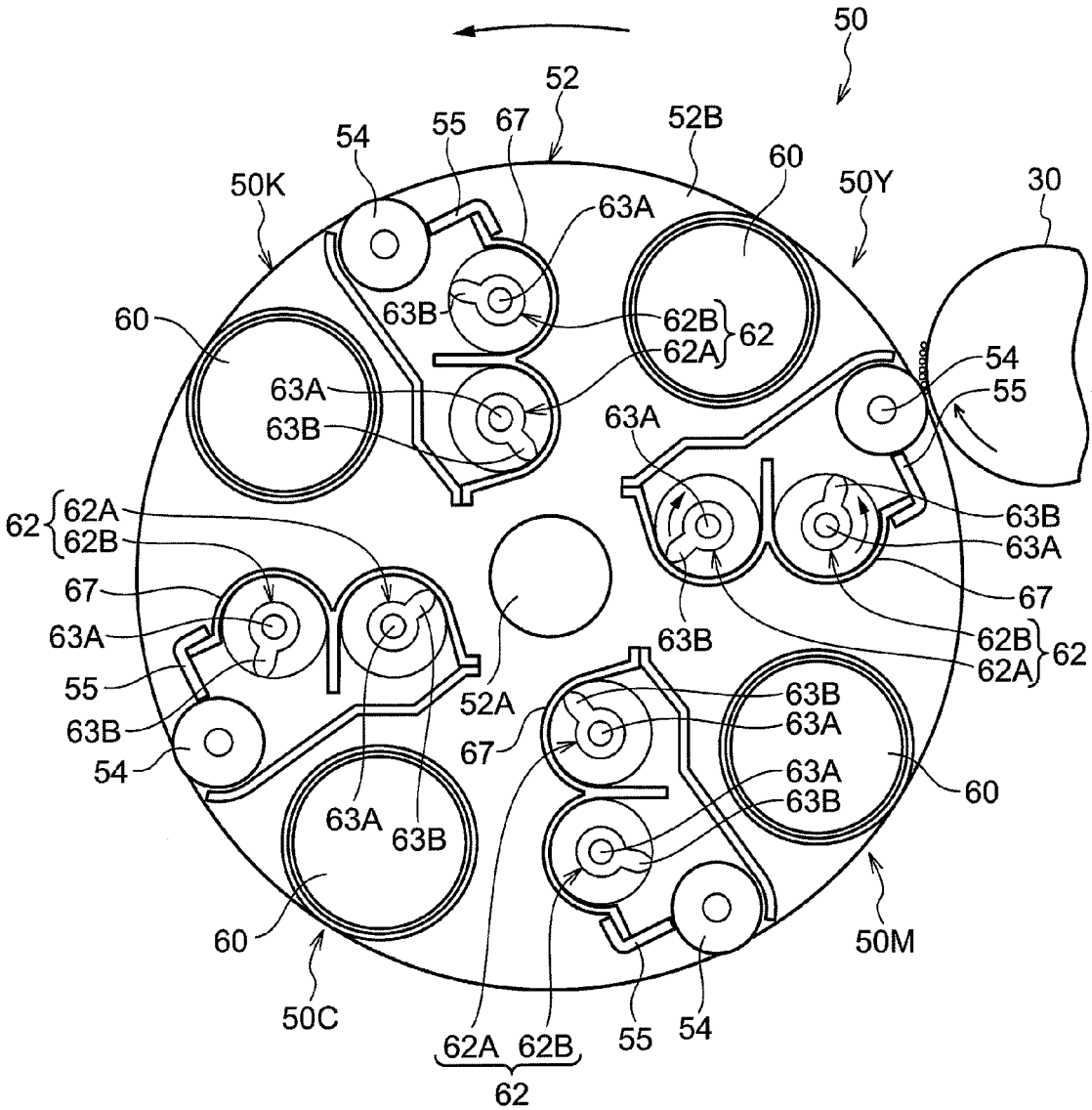
FIG. 2 is a schematic diagram showing the configuration of a developing apparatus according to the exemplary embodiment.
Figure 3:
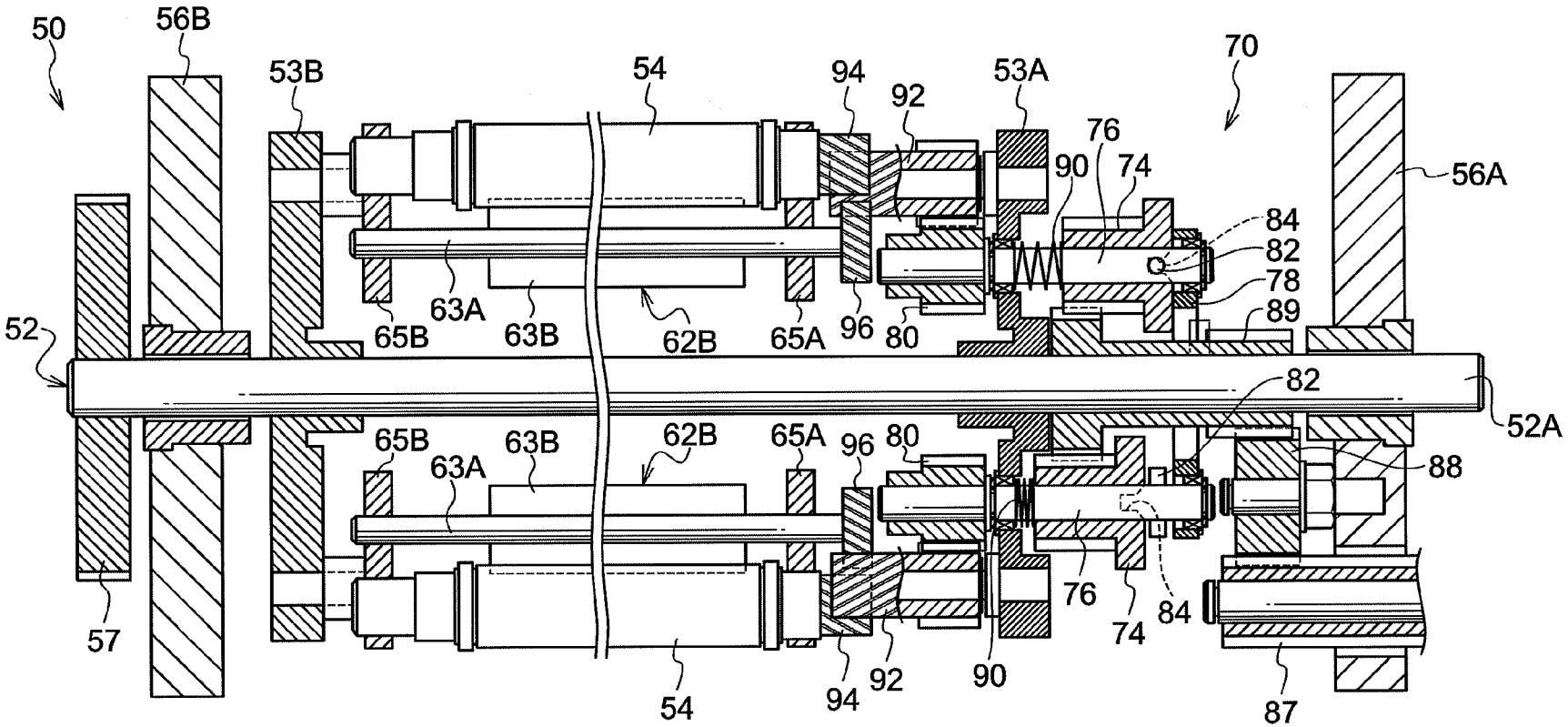
FIG. 3 is a schematic cross section showing the configuration of the developing apparatus according to the exemplary embodiment.

Next, the configuration of the developing apparatus 50 according to the exemplary embodiment will be described. FIGS. 2 and 3 are schematic diagrams showing the configuration of the developing apparatus 50 according to the exemplary embodiment.

The developing apparatus 50 according to the exemplary embodiment is an example of a rotor rotating apparatus in which a rotor rotates. As shown in FIGS. 2 and 3, the developing apparatus 50 has a first rotor 52 that rotates and four developing rolls 54 as an example of second rotors supported rotatably at the first rotor 52 so as to revolve around the axis of the first rotor 52 as the first rotor 52 rotates.

The rotor rotating apparatus is not limited to the developing apparatus 50 but may be, for example, a cleaning apparatus for removing toner residing on the photoconductive drum 30 but may be any configuration other than the developing apparatus 50 as long as rotors rotate. A cleaning apparatus for removing toner residing on the photoconductive drum 30 has, for example, a first rotor that rotates and plural removal rolls that remove toner residing on the photoconductive drum 30. Examples of the removal rolls include a roll-shaped porous member made by sponge or the like and a roll-shaped brush. In the configuration, for example, the first rotor is rotated, while changing the removal roll for each of the colors of toner residing on the photoconductive drum 30, the toner is collected.

The number of developing rolls 54 as the second rotors is not limited to four but may be one, three, five or more.

The first rotor 52 of the developing apparatus 50 according to the exemplary embodiment has a shaft member 52A whose ends in the axial direction are rotatably supported by supporting members 56A and 56B, and circular-shaped flange members 53A and 53B provided at both ends in the axial direction of the shaft member 52A and protruded from the shaft member 52A to the outside in the radial direction.

At one end in the axial direction (the left end in FIG. 3) of the shaft member 52A, a gear 57 as an example of a transmission element for transmitting the drive force from a not-shown drive motor to the shaft member 52A is attached. With the configuration, the drive force from the not-shown drive motor is transmitted via the gear 57 to the first rotor 52, and the first rotor 52 rotates in one direction (the counterclockwise direction in FIGS. 1 and 2) using the shaft member 52A as a rotation center.

The first rotor 52 is provided with the four developing units 50Y, 50M, 50C, and 50K of yellow (Y), magenta (M), cyan (C), and black (K) in the circumferential direction of the shaft member 52A in a cylindrical space formed by the flange members 53A and 53B.

Each of the developing units 50Y, 50M, 50C, and 50K has the developing roll 54, a developer container 60 containing a developer corresponding to the each of color, a developer supply member 62 for supplying the developer supplied from the developer container 60 to the developing roll 54, a casing 67 enclosing the developing roll 54 and the developer supply member 62, and a regulating member 55 regulating the amount of the developer held by the developing roll 54.

The developing roll 54 is an example of a developer supply member for supplying a developer to a latent image on the photoconductive drum 30. The developing roll 54 is provided at each of the developing units 50Y, 50M, 50C, and 50K, so that plural developing rolls 54 are provided at the first rotor 52.

The developer supply member 62 has a conveyance member 62A for conveying the developer to one side in the axial direction of the developing roll 54, and a conveyance member 62B for conveying the developer conveyed by the conveyance member 62A to the other side in the axial direction of the developing roll 54.

Each of the conveyance members 62A and 62B has, for example, a rotatable rotation shaft 63A and a blade member 63B provided spirally around the axis of the rotation shaft 63A and capable of conveying toner as the rotation shaft 63A rotates.

The developing roll 54 and the conveyance members 62A and 62B are rotatably supported by support members 65A and 65B disposed at both ends in the axial direction. The support members 65A and 65B are attached to the first rotor 52 and rotate integrally with the first rotor 52. Consequently, the developing roll 54 revolves about the axis of the first rotor 52 as the first rotor 52 rotates.

With the configuration, in the developing apparatus 50 according to the exemplary embodiment, the developer is supplied from the developer container 60 to the conveyance member 62A. The supplied developer is conveyed by the conveyance member 62A to the direction of the axis of the conveyance member 62A. The developer conveyed by the conveyance member 62A is conveyed by the conveyance member 62B in the direction of the axis of the conveyance member 62B, and the conveyed developer is supplied to the developing rolls 54. The developer supplied to the developing rolls 54 is held by the developing rolls 54 and conveyed to the photoconductive drum 30. The developer conveyed to the photoconductive drum 30 regulates the amount of retention on the developing rolls 54 at the time of passing through the regulating member 55.

By the developing rolls 54, the developer conveyed to the position opposed to the photoconductive drum 30 is supplied to the photoconductive drum 30. By the operation, an electrostatic latent image on the photoconductive drum 30 is developed and a toner image is formed on the photoconductive drum 30.

(Rotating Mechanism for Rotating Developing Roll 54)

Next, the rotating mechanism for rotating the developing rolls 54 will be described. FIGS. 4 to 7 are schematic diagrams illustrating the configuration of a rotating mechanism according to the exemplary embodiment.

Figure 4:
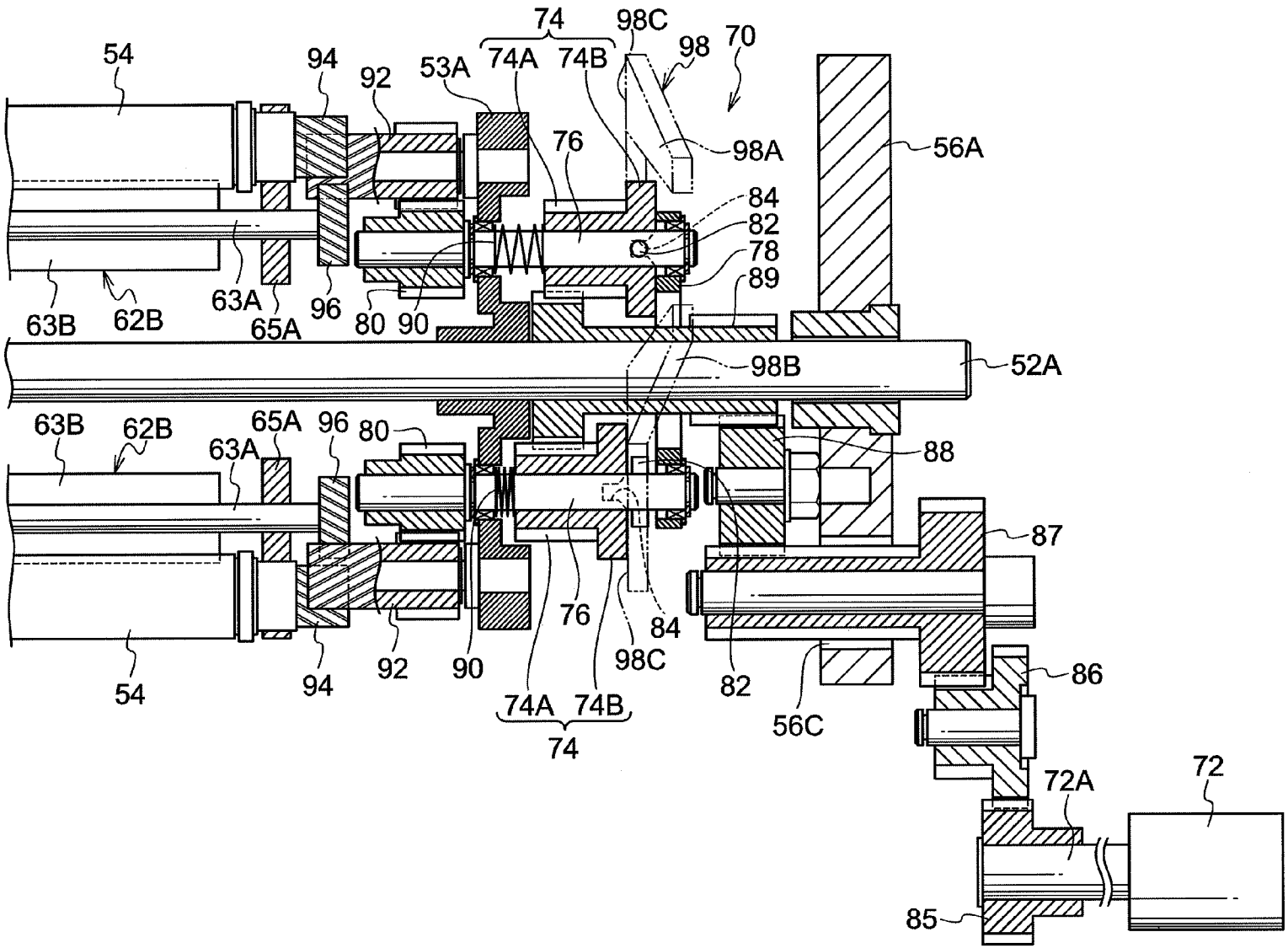
FIG. 4 is a schematic cross section showing a rotation mechanism for rotating a development roll according to the exemplary embodiment.
Figure 5:
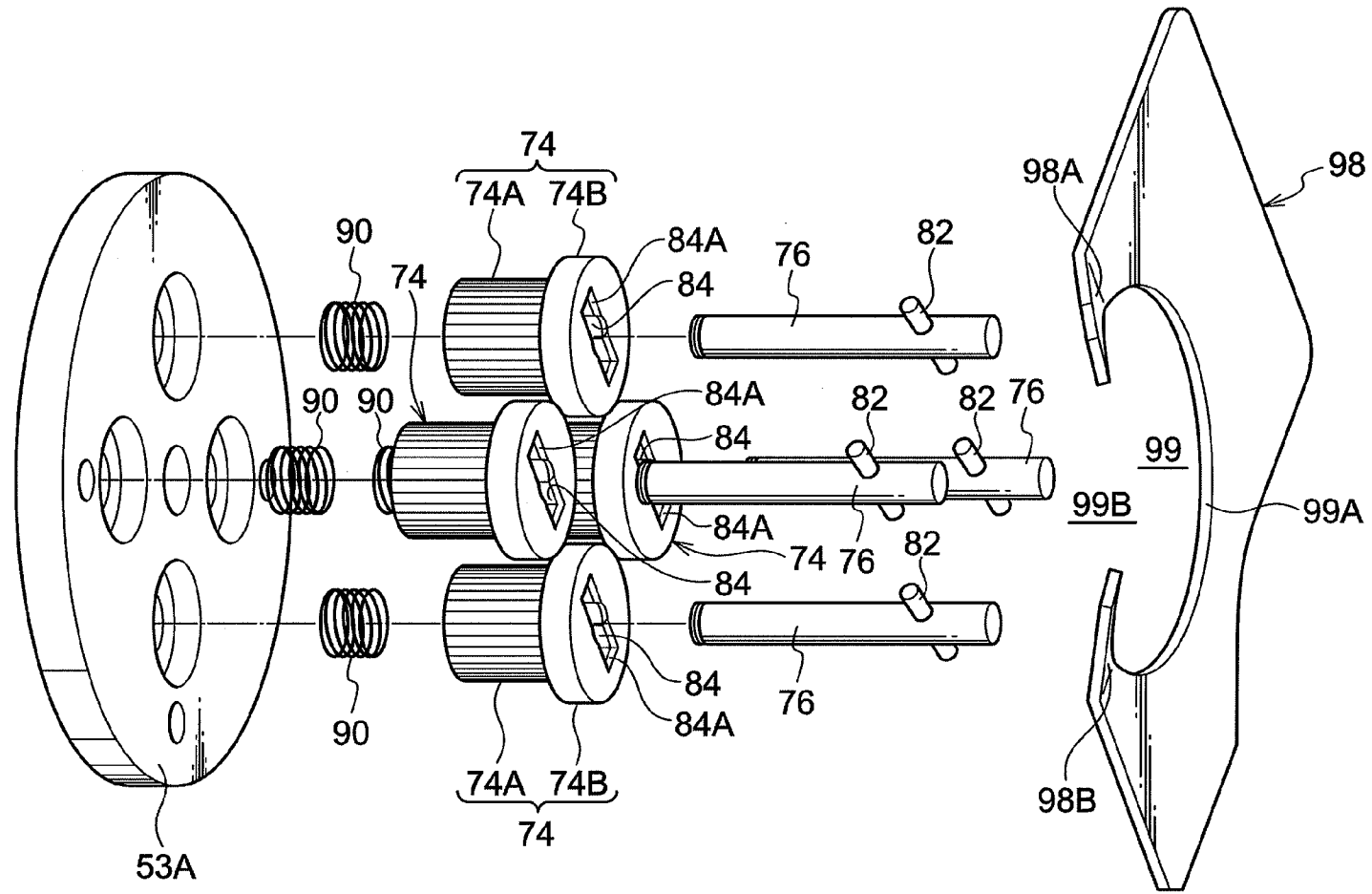
FIG. 5 is an exploded perspective view showing a part of the rotation mechanism for rotating the development roll according to the exemplary embodiment.

A rotating mechanism 70 according to the exemplary embodiment has, as shown in FIG. 4, a drive motor 72 as an example of the driving unit for generating a drive force for rotating the developing rolls 54, and a gear 74 as an example of a transmitting member capable of moving along the rotation axis direction of the developing rolls 54 between a transmission position where the gear 74 transmits the drive force from the drive motor 72 to the developing rolls 54 and a non-transmission position where the gear 74 runs idle so that the drive force from the drive motor 72 is not transmitted to the developing rolls 54. As shown in FIG. 5, the gear 74 is provided at each of the developing rolls 54 and, in the exemplary embodiment, four gears 74 are provided.

As shown in FIG. 4, the rotating mechanism 70 has gears 85, 86, 87, 88, and 89 as an example of the transmitting mechanism for transmitting the drive force from the drive motor 72 to the gear 74, a rotary shaft 76 as an example of the transmitting mechanism for transmitting the drive force from the drive motor 72 from the gear 74 to the developing rolls 54, and gears 80, 92, and 94.

The gears 85, 86, 87, 88, and 89 are commonly used by the four gears 74 and are respectively provided. The rotary shaft 76 and the gears 80, 92, and 94 are provided at each of the developing rolls 54 same as the gears 74. In the exemplary embodiment, four rotary shafts 76, four gears 80, four gears 92, and four gears 94 are provided.

The transmitting member for transmitting the drive force from the drive motor 72 to the gear 74 is not limited to the configuration constructed by the plural gears but may be constructed by a single gear. As the transmitting member for transmitting the drive force from the drive motor 72 from the gear 74 to the developing roll 54, a configuration that there are no gears 80, 92, and 94 and the rotary shaft 76 is directly coupled to the developing roll 54 may be employed.

The transmitting member is not limited to a gear but may be, for example, a mechanical element such as a belt, a chain, a link, or a converting mechanism (for example, a crank) for converting linear motion to rotation motion. A member other than a gear may be used as long as the member can transmit drive force.

The gear 85 is attached to a drive shaft 72A of the drive motor 72 and rotates integrally with the drive shaft 72A. The gear 86 has a large-diameter part and a small-diameter part and is rotatably supported by a not-shown supporting member. The large-diameter part engages with the gear 85. The gear 87 has a large-diameter part and a small-diameter part and is rotatably supported by a not-shown supporting member. The large-diameter part of the gear 87 engages with the small-diameter part of the gear 86. The small-diameter part of the gear 87 is inserted in a notch 56C formed at a support member 56A in a state where it is not in contact with the support member 56A. The gear 88 is rotatably supported by the support member 56A and engages with the small-diameter part of the gear 87. The gear 89 has a large-diameter part and a small-diameter part and is rotatably supported by the shaft member 52A. The small-diameter part engages with the gear 88, and the large-diameter part engages the four gears 74.

The four rotary shafts 76 are disposed along the rotation axis direction of the developing roll 54, an intermediate part in the axial direction is rotatably supported by the flange member 53A, and one end in the axial direction (the right end in FIGS. 3 and 4) is rotatably supported by a support member 78.

The gear 80 is attached to the other end of the rotary shaft 76 (the end opposite to the end supported by the support member 78) and rotates integrally with the rotary shaft 76. The gear 92 is rotatably supported by the flange member 53A and engages with the gear 80. The gear 94 is attached to one end in the axial direction of the developing roll 54, rotates integrally with the developing roll 54, and engages with the gear 92.

The gear 92 engages also with a gear 96 provided at one end in the axial direction of the rotation shaft 63A of the conveyance member 62B, and the conveyance member 62B also rotates as the gear 92 rotates.

Each of the four gears 74 has, as shown in FIGS. 4 and 5, a cylindrical gear part 74A in which gear teeth are formed, and a large-diameter part 74B protruded to the outside in the radial direction of the gear part 74A and having a diameter larger than that of the gear part 74A.

Each gear 74 is disposed in the rotary shaft 76 so that the large-diameter part 74B faces the support member 78 side between the support member 78 and the flange member 53A, and is supported rotatably by the rotary shaft 76 and movably along the axial direction of the rotary shaft 76.

A pin 82, which is an example of a part to which drive force is transmitted from a transmitting part which will be described later, is disposed at one end (the end supported by the support member 78) in the axial direction of the rotary shaft 76, further toward the other end in the axial direction than the part supported by the support member 78. The pin 82 penetrates the rotary shaft 76 along the radial direction of the rotary shaft 76, projects externally from the rotary shaft 76 in opposite directions in the radial direction, and rotates integrally with the rotary shaft 76.

In the large-diameter part 74B of the gear 74, a groove 84, which is an example of the transmitting part for transmitting the drive force to the part to which the drive force is transmitted, is formed at an end face on the side of the support member 78. An inclined face 84A which is inclined toward the bottom of the groove 84 is formed at the opening edge of the groove 84. The pin 82 is guided into the groove 84 along the inclined face 84A.

In the gear 74, the pin 82 is inserted in the groove 84, and the gear 74 and the rotary shaft 76 are coupled to each other. When the gear 74 rotates in a state where the pin 82 is inserted in the groove 84, the inner wall of the groove 84 pushes the circumferential face of the pin 82, the drive force is transmitted from the groove 84 to the pin 82, and the rotary shaft 76 rotates. As described above, in the exemplary embodiment, the position where the pin 82 is inserted in the groove 84 in the gear 74 is the transmission position of the gear 74.

The gear 74 moves along the rotary shaft 76 toward the flange member 53A and, when the pin 82 comes out of the groove 84, idles with respect to the rotary shaft 76. As described above, in the exemplary embodiment, the position where the pin 82 comes out of the groove 84 is the non-transmission position of the gear 74.

The part to which the drive force is transmitted is not limited to the pin 82 but members in various shapes may be used. The transmitting part is not limited to the groove 84 and its shape is changed according to the shape of the part to which the drive force is transmitted. Another configuration may be also employed that the pin 82 is disposed on the gear 74 side and used as the transmitting part, and the groove 84 is provided on the rotary shaft 76 side and used as the part to which the drive force is to be transmitted. That is, it is sufficient to form a state where the gear 74 and the rotary shaft 76 are coupled to each other and the drive force is transmitted from the gear 74 to the rotary shaft 76, and a state where the gear 74 and the rotary shaft 76 are disconnected from each other and the gear 74 idles.

To the rotary shaft 76, a compression coil spring 90 as an example of an elastic member generating elastic force is attached between the gear 74 (specifically, the gear part 74A) and the flange member 53A. One end of the compression coil spring 90 is in contact with the flange member 53A, and the other end is in contact with the gear 74 (specifically, the gear part 74A). By the elastic force, the gear 74 is pushed to the transmission position on the side of the supporting member 78.

The elastic member is not limited to the compression coil spring 90 but may be, for example, another spring such as a tension spring or plate spring, or another elastic member such as rubber. Any member other than the compression coil spring 90, which gives force toward the transmission position to the gear 74 may be employed.

The rotating mechanism 70 has a guide member 98 that moves the gear 74 to the transmission position by the pressing force of the compression coil spring 90 when the first rotator 52 is in a predetermined rotation position (a first rotation position), and moves the gear 74 to the non-transmission position against the pressing force of the compression coil spring 90 by rotation of the first rotor 52 from the opposition position opposing the photoconductive drum 30 to a non-opposing position.

As shown in FIG. 5, the guide member 98 is formed in a plate shape which is flat along the radial direction of the shaft member 52A and the rotary shaft 76. As shown in FIG. 4, the guide member 98 is disposed so as to overlap the pins 82 when viewed from the radial direction of the rotary shaft 76.

In the guide member 98, the opposed face 98C opposing the gear 74 side is formed further toward the flange member 53A than the pin 82. The opposed face 98C serves as the contact face which comes into contact with the gear 74 (specifically, with the large-diameter part 74B).

Figure 6:
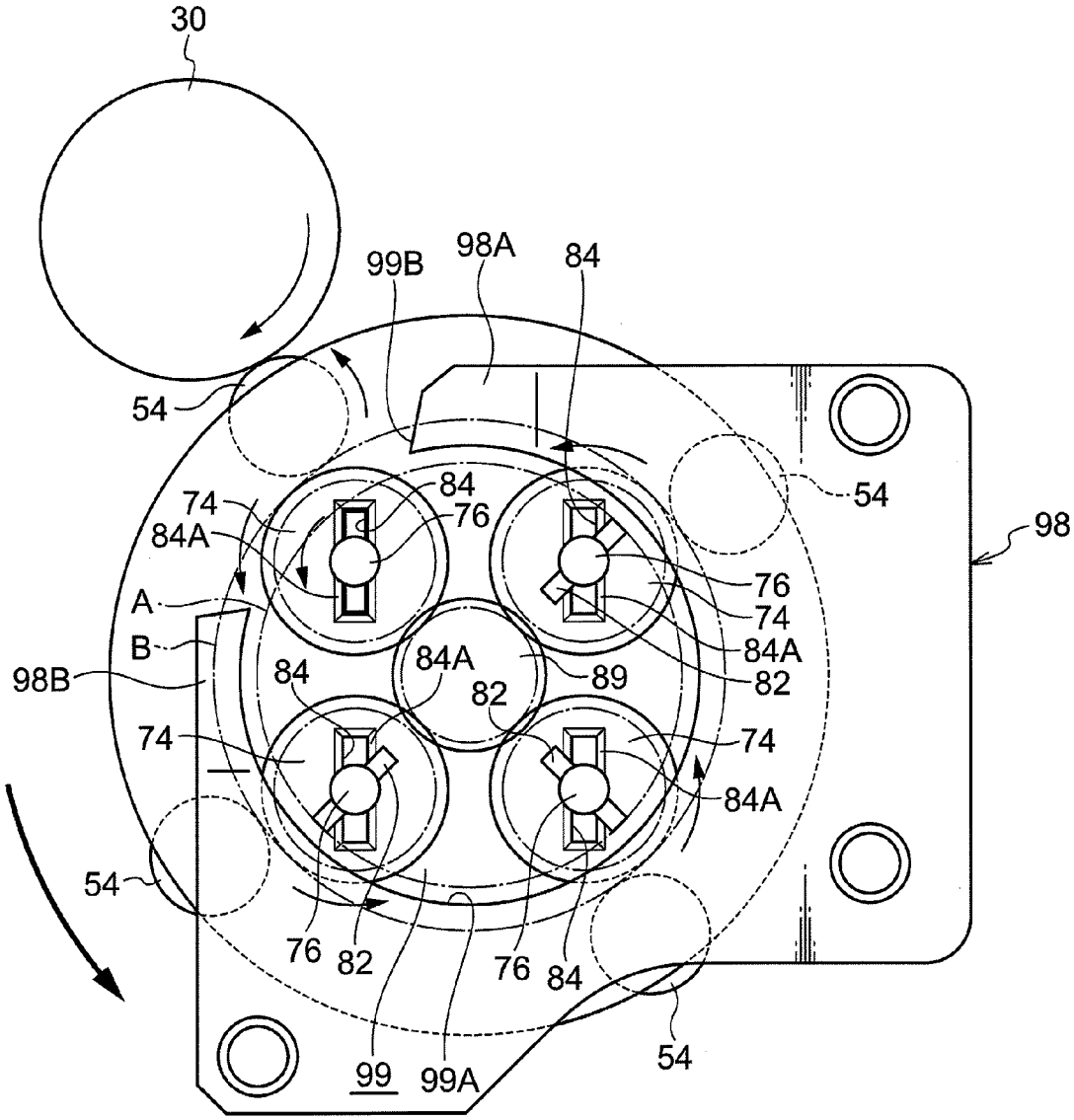
FIG. 6 is a schematic side view showing the rotation mechanism for rotating the development roll according to the exemplary embodiment.

As shown in FIG. 6, a circular hole 99 is formed at the guide member 98. The inner edge 99A of the circular hole 99 is positioned on the outer peripheral side of the outermost orbit A of the pin 82 when moved by rotation of the first rotor 52 and on the inner peripheral side of the outermost orbit B of the gear 74 (specifically, the large-diameter part 74B) when moved by rotation of the first rotor 52. With this configuration, the pin 82 can rotate in the circular hole 99 without contacting the guide member 98, and a part of the gear 74 (specifically, the large-diameter part 74B) can be in contact with the guide member 98.

In the guide member 98, a notch 99B formed continuously with the circular hole 99 and notching a part of the periphery of the circular hole 99 is formed. The notch 99B is formed at a position opposing the photoconductive drum 30.

As shown in FIG. 6, when seen from one side in the axial direction of the shaft member 52A and the rotary shaft 76, the guide member 98 does not overlap the gear 74 (specifically, the large-diameter part 74B) for driving the developing roll 54 in the position opposing the photoconductive drum 30, but overlaps a part of the three gears 74 for driving the developing rolls 54 in non-opposed positions where the developing rolls 54 do not oppose the photoconductive drum 30.

Figure 7:
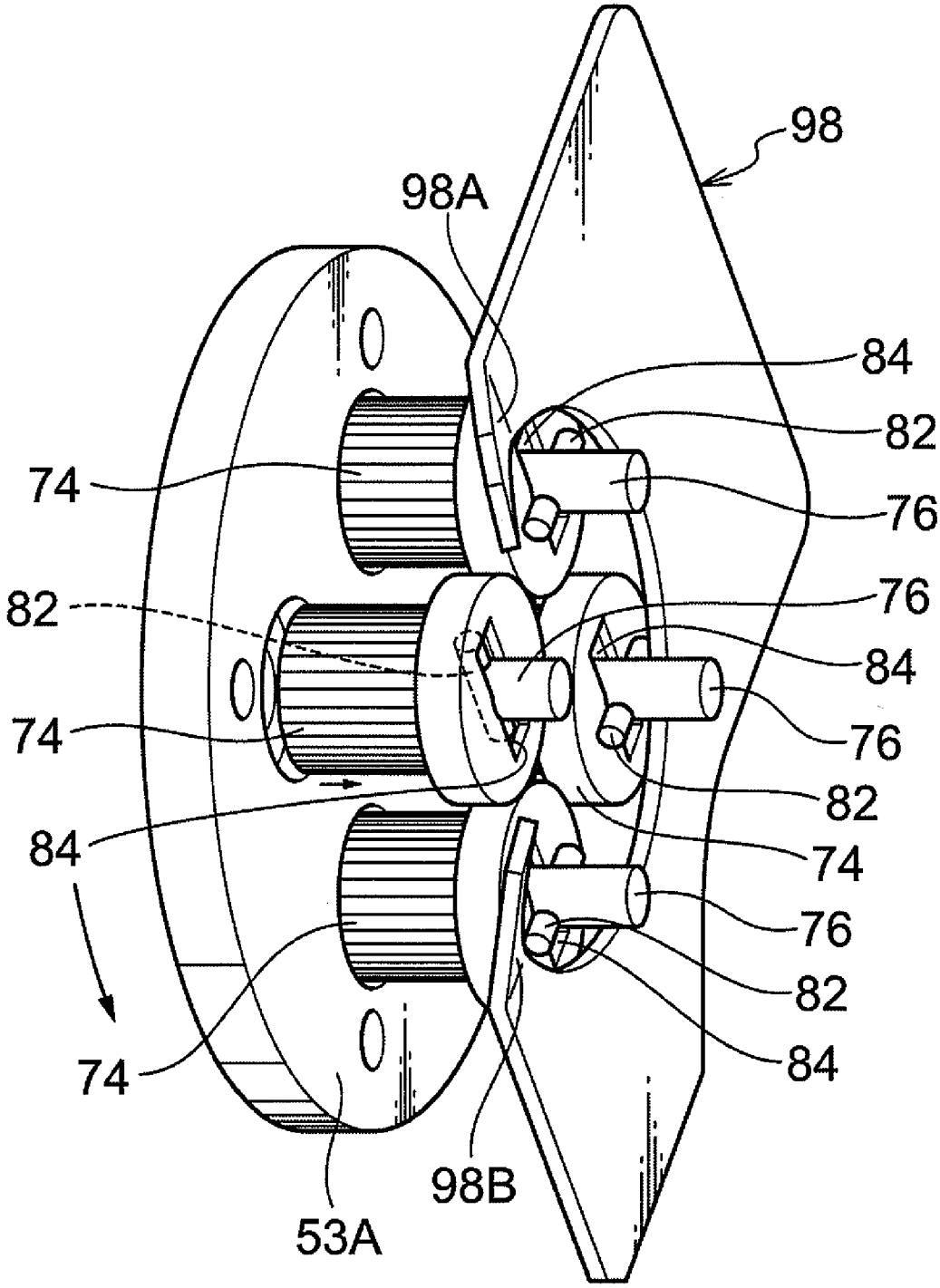
FIG. 7 is a schematic perspective view showing a part of the rotation mechanism for rotating the development roll according to the exemplary embodiment.

Consequently, as shown in FIG. 7, the guide member 98 is in contact with the three gears 74 (specifically, the large-diameter parts 74B) for the developing rolls 54 positioned in the non-opposed positions, and in contact further toward the compression coil springs 90 than the pins 82, and is not in contact with the one gear 74 (specifically, the large-diameter part 74B) for the developing roll 54 in the opposed position. With this configuration, when the first rotor 52 rotates, among the four gears 74, the guide member 98 moves the gear 74 to be moved to the opposed position opposing the photoconductive drum 30, to the transmission position. Thus, one of the four gears 74 can selectively be moved to the transmission position. It is sufficient that a part (including plural parts) of the plural gears 74 can be selectively moved to the transmission position.

The guide member 98 has: a guide part 98A guiding the gear 74 to the transmission position so that the gear 74 is slowly moved to the transmission position by the pressing force of the compression coil spring 90, and a guide part 98B slowly guiding the gear 74 to the non-transmission position against the pressing force of the compression coil spring 90.

The guide part 98A is formed by a projecting part projected along the movement direction of the developing roll 54 moving from the non-opposed position to the opposed position. The guide part 98B is formed by a projecting part projected along the direction opposite to the movement direction of the developing roll 54 moving from the opposed position to the non-opposed position.

As shown in FIGS. 4 and 5, the guide parts 98A and 98B are deformed toward the tip ends thereof so as to slowly bend toward the side of the support member 78 along the axial direction of the rotary shaft 76. With this configuration, the contact face, which comes into contact with the gear 74, of each of the guide parts 98A and 98B is inclined toward the side of the support member 78 toward the tip end thereof.

The guide member 98 is not limited to the above-described configuration but may have a configuration including, for example, no guide parts 98A and 98B. The guide member 98 may be any member that moves the gear 74 to the transmission position by pressing force of the compression coil spring 90 when the first rotor 52 is in a predetermined rotation position, and guides the gear 74 to the non-transmission position against the pressing force of the compression coil spring 90.

Next, the mechanism of the exemplary embodiment will be described.

In the configuration of the exemplary embodiment, when the first rotor 52 rotates and one of the four developing rolls 54 selectively rotates from the position opposing the photoconductive drum 30 to the non-opposing position, the gear 74 (specifically, the large-diameter part 74B) of the developing roll 54 positioned in the opposed position rotates while being in contact with the contact face of the guide part 98B.

When the gear 74 (specifically, the large-diameter part 74B) rotates while in contact with the contact face of the guide part 98B, the gear 74 is slowly moved toward the non-transmission position at the side of the compression coil spring 90 along the incline of the contact face of the guide part 98B and against the elastic force of the compression coil spring 90.

As a result of this movement, the pin 82 comes out of the groove 84 in the gear 74, the gear 74 idles, and the drive force from the drive motor 72 is not transmitted from the gear 74 to the rotary shaft 76. At this time, the engaged state of the gears 85, 86, 87, 88, and 89 disposed between the drive motor 72 and the gear 74 is maintained, the drive force from the drive motor 72 is transmitted to the gear 74, and the gear 74 is rotated.

Since movement to the non-transmission position of the gear 74 is performed slowly, impact when moving the gear 74 is reduced. When the gear 74 moves to the non-transmission position, the developing roll 54 to which the drive force is transmitted by another gear 74 positioned in the transmission position is less likely to be affected by the impact, so that supply unevenness of the developer caused by the impact is suppressed. When a transfer operation is performed when the gear 74 moves to the non-transmission position, deviation of the transfer position caused by the impact is suppressed.

Further, even when the first rotor 52 rotates, when the developing roll 54 is in the non-opposing position, a state in which the gear 74 is in contact with the contact face of the guide member 98 is maintained and the gear 74 is in the non-transmission position. Consequently, the gear 74 idles, and the drive force from the drive motor 72 is not transmitted from the gear 74 to the rotary shaft 76.

By the rotation of the first rotor 52, the development roll 54 which rotates from the non-opposing position to the opposing position rotates while the gear 74 (specifically, the large-diameter part 74B) is in contact with the contact face of the guide part 98A. When the gear 74 rotates while being in contact with the contact face of the guide part 98A, the gear 74 is slowly moved to the transmission position at the side of the support member 78 along the inclination of the contact face of the guide part 98A due to the pressing force of the compression coil spring 90.

Consequently, the pin 82 is inserted into the groove 84 in the gear 74, the drive force from the drive motor 72 is transmitted from the gear 74 to the rotary shaft 76, and the developing roll 54 rotates. At this time, the gears 74 of the other three developing rolls 54 are in the non-transmission positions, so that the drive force is not transmitted thereto, and the developing rolls 54 remain in a resting state. As described above, a part of the plural developing rolls 54 is selectively rotated.

When the gear 74 is in the transmission position, the gear 74 rotates while not in contact with the guide member 98, the compression coil spring 90 extends more than when the gear 74 is in the non-transmission position, and the pressing force acting on the gear 74 decreases. Consequently, as compared with the case in which the gear 74 rotates in contact with the guide member 98 or the case in which the gear 74 rotates in a state in which the gear 74 is moved toward the side of the compression coil spring 90 against the pressing force of the compression coil spring 90, the rotational load at the time of rotating the developing roll 54 is reduced.

Since movement to the transmission position of the gear 74 is performed slowly, impact when moving the gear 74 is reduced. Consequently, the developing roll 54 to which the drive force is transmitted by the gear 74 moved to the transmission position is less likely to be affected by the impact, whereby supply unevenness of the developer caused by the impact is suppressed. When a transfer operation is performed when the gear 74 moves to the transmission position, deviation of the transfer position caused by the impact is suppressed.

Figure 8:
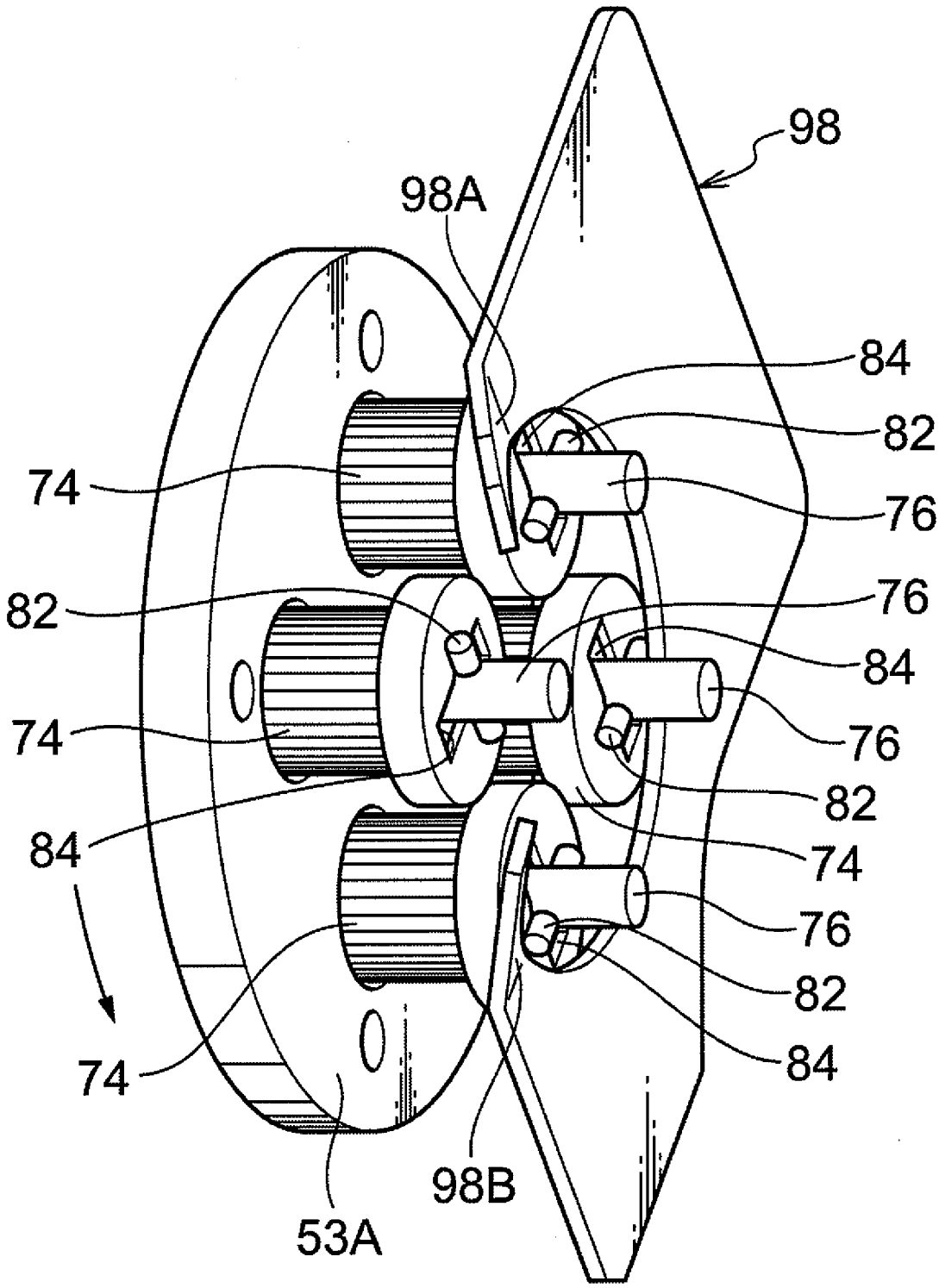
FIG. 8 is a schematic perspective view showing a state where the direction of a pin and the direction of a groove do not match when a gear according to the exemplary embodiment is pressed by a compression coil.

When the gear 74 is pushed to the side of the support member 78 by the pressing force of the compression coil spring 90, when the direction of the pin 82 and that of the groove 84 do not match as shown in FIG. 8, the pin 82 is not inserted in the groove 84, and the gear 74 does not move to the transmission position. However, in the exemplary embodiment, rotation of the rotary shaft 76 with respect to the rotation of the gear 74 is suppressed by the weight of the developing roll 54 or the like, and, by the time the gear 74 has rotated, at most, once in an idling state, the directions of the pin 82 and the groove 84 match, the pin 82 is inserted in the groove 84, and the gear 74 moves to the transmission position.

Although the guide member has been explained with respect to an aspect where the transmission member is moved by the pressing force of the compression coil spring 90 as the elastic member, the invention is not limited to this aspect. For example, another configuration may be employed such that two rails are disposed for a guide member that is fixedly disposed, the transmission member moves along the rails with rotation of the first rotor and is positioned in the transmission position in the opposed position.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A rotor rotating apparatus comprising:

a first rotor that rotates;

a second rotor supported rotatably at the first rotor and so as to revolve around an axis of the first rotor with rotation of the first rotor;

a drive unit that generates drive force for rotating the second rotor;

a transmission member configured to move along a direction of a rotation axis of the second rotor between a transmission position at which the transmission member transmits the drive force from the drive unit to the second rotor and a non-transmission position at which the transmission member idles: and a guide member that moves the transmission member to the transmission position when the first rotor is in a first rotation position, and moves the transmission member to the non-transmission position by rotation of the first rotor from the first rotation position, wherein the guide member moves the transmission member to the transmission position using elastic force of an elastic member when the first rotor is in the first rotation position, and moves the transmission member to the non-transmission position against the elastic force of the elastic member by rotation of the first rotor from the rotation position.

2. The rotor rotating apparatus according to claim 1, wherein the guide member has a guide unit that guides the transmission member to the transmission position so that the transmission member is slowly moved to the transmission position by the elastic force of the elastic member.

3. The rotor rotating apparatus according to claim 1, wherein the guide member has a guide unit that slowly guides the transmission member to the non-transmission position against the elastic force of the elastic member.

4. The rotor rotating apparatus according to claim 1, wherein the transmission member comprises:

a rotary shaft extending along the rotation axis direction of the second rotor and having a pin that penetrates the rotary shaft along the radial direction of the rotary shaft, protrudes externally from the rotary shaft in the radial direction of the rotary shaft, and rotates integrally with the rotary shaft; and a gear having a groove in which the pin is inserted so as to transmit drive force to the pin in the transmission position.

5. The rotor rotating apparatus according to claim 4, wherein an inclined face which is inclined toward the bottom of the groove and guides the pin into the groove is formed at a rim of the groove.

6. A developing apparatus comprising:

a first rotor that rotates;

a plurality of developer supply members supported rotatably at the first rotor and so as to revolve around an axis of the first rotor with rotation of the first rotor, the developer supply members supplying developer to a latent image;

a drive unit that generates drive force for rotating the developer supply members;

a plurality of transmission members provided respectively at the plurality of developer supply members, each transmission member configured to move along a direction of a rotation axis of the respective developer supply member between a transmission position at which the transmission member transmits the drive force from the drive unit to the developer supply member and a non-transmission position at which the transmission member idles; and a guide member that moves the transmission member to the transmission position when the first rotor is in a first rotation position, and moves the transmission member to the non-transmission position by rotation of the first rotor from the first rotation position, wherein the guide member moves the transmission member to the transmission position using elastic force of an elastic member when the first rotor is in the first rotation position, and moves the transmission member to the non-transmission position against the elastic force of the elastic member by rotation of the first rotor from the rotation position.

7. The developing apparatus according to claim 6, wherein the guide member has a guide unit that guides the transmission member to the transmission position so that the transmission member is slowly moved to the transmission position by the elastic force of the elastic member.

8. The developing apparatus according to claim 6, wherein the guide member has a guide unit that slowly guides the transmission member to the non-transmission position against the elastic force of the elastic member.

9. The developing apparatus according to claim 6, wherein the transmission member comprises:

a rotary shaft extending along the rotation axis direction of the second rotor and having a pin that penetrates the rotary shaft along the radial direction of the rotary shaft, protrudes externally from the rotary shaft in the radial direction of the rotary shaft, and rotates integrally with the rotary shaft; and a gear having a groove in which the pin is inserted so as to transmit drive force to the pin in the transmission position.

10. The developing apparatus according to claim 9, wherein an inclined face which is inclined toward the bottom of the groove and guides the pin into the groove is formed at a rim of the groove.

11. An image forming apparatus comprising:

a latent image holding member that holds a latent image;

the developing apparatus according to claim 6, that develops the latent image to form a toner image on the latent image holding member; and a transfer device that transfers the toner image formed on the latent image holding member by the developing apparatus to a member to which the toner image is to be transferred, wherein the guide member moves the transmission member to the transmission position using elastic force of an elastic member when the first rotor is in the first rotation position, and moves the transmission member to the non-transmission position against the elastic force of the elastic member by rotation of the first rotor from the rotation position.

12. The image forming apparatus according to claim 11, wherein the guide member has a guide unit that guides the transmission member to the transmission position so that the transmission member is slowly moved to the transmission position by the elastic force of the elastic member.

13. The image forming apparatus according to claim 11, wherein the guide member has a guide unit that slowly guides the transmission member to the non-transmission position against the elastic force of the elastic member.

* * * * *